US006202416B1

(12) United States Patent
Gray, Jr.

(10) Patent No.: US 6,202,416 B1
(45) Date of Patent: Mar. 20, 2001

(54) DUAL-CYLINDER EXPANDER ENGINE AND COMBUSTION METHOD WITH TWO EXPANSION STROKES PER CYCLE

(75) Inventor: Charles L. Gray, Jr., Pinckney, MI (US)

(73) Assignee: The United States of America as represented by the Administrator of the U.S. Environmental Protection Agency, Washington, DC (US)

( * ) Notice: Subject to any disclaimer, the term of this patent is extended or adjusted under 35 U.S.C. 154(b) by 0 days.

(21) Appl. No.: 09/344,502

(22) Filed: Jun. 25, 1999

Related U.S. Application Data

(60) Provisional application No. 60/096,403, filed on Aug. 13, 1998.

(51) Int. Cl.[7] ..... F02G 3/02
(52) U.S. Cl. ..... 60/620; 60/622
(58) Field of Search ..... 60/620, 622; 92/138

(56) References Cited

U.S. PATENT DOCUMENTS 1,213,917 1/1917 Steinhauer et al. .
5,199,262 4/1993 Bell ..... 60/622

FOREIGN PATENT DOCUMENTS 509556 9/1926 (DE) ..... 60/620
614873 9/1926 (FR) ..... 60/622

OTHER PUBLICATIONS

SAE Technical Paper No. 930986, "Design Optimization of the Piston Compounded Adiabatic Diesel Engine Through Computer Simulation", Mar. 1, 1993.

*Primary Examiner*—Michael Koczo

(57) ABSTRACT

An internal combustion engine is provided with an expansion cylinder and at least one combustion cylinder, preferably two or four combustion cylinders per expansion cylinder. An air-fuel mixture is ignited within the combustion cylinders to drive a combustion piston which, in turn, drives an engine crankshaft. The gaseous products of combustion are exhausted at a pressure substantially above atmospheric to an expansion cylinder wherein they are allowed to further expand against an expander piston to drive an expander crankshaft. Torque produced at the engine crankshaft and torque produced at the expander crankshaft are combined to drive vehicle wheels.

8 Claims, 8 Drawing Sheets

DUAL-CYLINDER EXPANDER ENGINE AND COMBUSTION METHOD WITH TWO EXPANSION STROKES PER CYCLE

This application claims benefit to U.S. provisional 60/096,403 filed Aug. 13, 1998.

BACKGROUND OF THE INVENTION

1. Field of the Invention

The field of the invention is internal-combustion engines for motor vehicles.

2. Related Art

The growing utilization of automobiles greatly adds to the atmospheric presence of various pollutants including oxides of nitrogen and greenhouse gases such as carbon dioxide. Accordingly, a need exists for a new approach which can significantly improve the efficiency of fuel utilization for automotive powertrains while still achieving low levels of NOx emissions.

Internal combustion engines create mechanical work from fuel energy by combusting the fuel over a thermodynamic cycle consisting (in part) of compression, ignition, and expansion. The efficiency with which mechanical work is converted from the available fuel energy is determined by the thermodynamic efficiency of the cycle. Thermodynamic efficiency, in turn, is determined in part by (a) the degree to which the fuel/air mixture is compressed prior to ignition (compression ratio), and (b) the final pressure to which the combusted mixture can be expanded while performing useful work on the piston which is related to the expansion ratio of the power or expansion stroke. Generally speaking, the lower the final pressure achieved during expansion against the piston, the greater the amount of work extracted. The pressure drop is limited by the fixed maximum volume of the cylinder, since there is only a finite volume available in which combusting gases may expand and still perform work on the piston. At some point the piston will reach bottom dead center, after which the gases, still at a high enough pressure to perform work, must be exhausted from the cylinder as the piston begins to rise again.

To fully utilize the pressure of the combustion gases, it would be necessary to expand the gases to ambient pressure while pushing against the piston. The phenomenon is illustrated in FIG. 1. Normally, gases are exhausted to the atmosphere when the expansion of the combustion cylinder stops. Some of the work extracted is represented by the unshaded area under the curve. The pressure of this exhausted gas is still higher than ambient pressure. If this residual pressure were expanded against another piston to ambient pressure, the additional work would equal the area represented by the shaded area under the curve. Some of this additional work ("A") would go toward operating the engine itself, but a significant amount ("B") would remain to create a net increase in work extracted.

Reaching such a low pressure would require a larger volume in which to expand the products of combustion, suggesting that the stroke of the piston or the maximum volume of the cylinder should be increased during the expansion stroke. Of course, the compression ratio would then increase in the same manner because the compression ratio is also governed by maximum cylinder volume. The result would be simply a larger engine cylinder, or an unacceptably large compression ratio.

Conventional engines are limited to having an expansion ratio roughly equal to the compression ratio. This is because compression and expansion both take place in a single cylinder that has a fixed maximum and minimum volume. It is possible to effectively change the two ratios relative to one another by manipulating the characteristics of the fuel-air mixture. For example, turbocharging and supercharging are used to increase the effective compression ratio relative to the expansion ratio. This is done by forcing a greater mass of air (and ultimately fuel/air mixture) into the combustion chamber without changing the actual volumetric compression ratio. This leads to increased power for a given engine displacement. But this approach does not affect the actual volumes involved and cannot provide a way to improve the expansion ratio relative to the compression ratio. Similarly, by restricting the flow of air into the cylinder during the intake stroke, or by other manipulation of exhaust or intake valves, it would be possible to reduce the effective compression ratio relative to the expansion ratio. However, this would introduce fluid-mechanical problems due to air flow and cylinder pressures that would probably require sophisticated timing strategies and detrimentally affect the efficiency of the thermodynamic cycle.

An engine design for increasing the expansion ratio relative to the compression ratio by means of dual cylinder expansion, is disclosed in a 1993 paper published by the Society of Automotive Engineers (SAE number 930986). The disclosed design includes an auxiliary cylinder dedicated to further expansion of gases against a piston after they have been exhausted from the main combustion cylinders. The system also includes a compression cylinder to provide supercharging capability. However, the valving arrangements of this system would require two additional valves per cylinder, one for supercharging and one for expanding, for a total of four valves per combustion cylinder. In addition, the design disclosed in this SAE paper utilizes two valves each, for the separate expansion and companion cylinders. The configuration as shown requires long runners between the combustion cylinders and the auxiliary cylinders, which runners would increase the effective expansion volume, introduce pressure losses, and possibly introduce back-pressure problems that would require complex valving and control to overcome. Its main purpose seems to be to improve power output rather than reduce NOx emissions and improve energy conversion efficiency, as indicated by an integrated supercharging device.

SUMMARY OF THE INVENTION

The present invention is a unique mechanism, with a simplified valve arrangement and/or drive output, for increasing the expansion ratio relative to the compression ratio, thereby allowing the additional pressure of expanding gases to be brought closer to ambient pressure while performing useful work. The engine combustion cylinders (hereafter called engine cylinders) are connected to expansion cylinders which can be arranged to minimize or eliminate runner length. Valving is simplified by elimination of all but a single exhaust valve between the expansion cylinder and the combustion cylinders. In at least one embodiment, there is one complete cycle of the expansion cylinder for every stroke of the connected 4-stroke combustion cylinder. Thus, up to four combustion cylinders of a four-stroke engine could be served by a single expansion cylinder.

In at least one embodiment, gases are not delivered to the expansion cylinder(s) until the gases in the engine cylinder have reached their maximum expansion, so that all of the energy produced by the expansion within the expansion cylinder is energy that would otherwise have been discarded. The invention is dedicated to improving the thermodynamic efficiency of the cycle, and does not require additional energy for supercharging or other means of power improvement, although same could be added very efficiently.

Using the apparatus of the present invention, the combustion cylinder can be operated with late fuel ignition to minimize NOx formation, while the expansion chamber allows full expansion of the combustion gases.

Accordingly, the present invention provides an internal combustion engine which includes at least one combustion cylinder with a combustion piston reciprocably mounted therein and an expansion cylinder with an expansion piston reciprocably mounted therein. Each combustion cylinder has at least one intake port for intake of combustion air and at least one exhaust port for exhausting the gaseous products of combustion, as well as ignition means for igniting an air-fuel mixture therein to produce the gaseous products of combustion. The one or more combustion pistons are linked to an engine crankshaft whereby the crankshaft is driven responsive to combustion within the one or more combustion cylinders. The expansion cylinder is provided with a gas inlet port for receiving the gaseous products of combustion exiting the combustion cylinder or cylinders at a pressure above atmospheric and a gas outlet port for exhausting the exhaust gases to the ambient atmosphere after having undergone further expansion to drive the expander piston. The expander piston is linked to an expander crankshaft, whereby the expander crankshaft is driven and its output is combined with the output of the engine crankshaft at a drive shaft to drive the wheels of the vehicle. The flow of exhausted combustion gases out of the combustion cylinder and into the expansion cylinder, as well as the intake of combustion air into the combustion cylinder may be controlled by poppet valves mounted in the cylinder head closing the combustion cylinder. Alternatively, a combustion cylinder may be operated in conjunction with an expander cylinder using only two valves located, respectively, at an air intake duct for the combustion air and in a gas passage connecting the exhaust port of the combustion cylinder with the gas inlet port of the expansion cylinder. In this latter embodiment the gas inlet port is located above top dead center in the expansion cylinder and the gas outlet port is located adjacent bottom dead center, but between top dead center and bottom dead center so that the expander piston serves to open and close the gas outlet valve in the course of its reciprocating motion.

The present invention also provides a method of powering an engine vehicle with two expansion strokes per cycle of a combustion cylinder An air-fuel mixture is ignited within a combustion cylinder and the gaseous products of combustion are allowed to expand against a combustion piston to drive an engine crankshaft with a first amount of torque. The gaseous products of combustion are transferred from the combustion cylinder to an expansion cylinder at a pressure substantially above atmospheric pressure, and allowed to expand within the expansion cylinder against an expander piston, to drive an expander crankshaft with a second increment of torque. The two amounts of torque are then combined to drive wheels of the vehicle.

This invention also allows for operation of an internal combustion engine in a manner that reduces NOx formation without sacrificing efficiency. NOx formation in an internal combustion engine is strongly related to and increases with increasing peak combustion temperature. A common means of reducing peak combustion temperature, and thus NOx formation, is ignition of the fuel late in the compression stroke or early in the expansion stroke so that peak combustion temperature occurs after the engine has begun its expansion stroke, and the expansion process imparts a cooling effect on the combustion gases, thereby resulting in a lower peak combustion temperature. Unfortunately, such late combustion in conventional engines results in reduced fuel efficiency because the pressure resulting from combustion is occurring after the expansion process has begun, and the remaining effective expansion ratio is less than the compression ratio. The result is that the combustion pressure is not as fully expanded as it would have been had the ignition and pressure release occurred before the expansion process began. When the exhaust valve opens, the higher pressure gas is exhausted and its remaining energy is wasted. In contrast, this invention allows operation with late ignition and low NOx formation, but without the fuel economy penalty associated with such operation in conventional engines. This combination is possible because the second expander cylinder is still capable of full expansion of the combustion gas pressure.

The unique features of the invention provide the following advantages over conventional engines and over prior methods of increasing the expansion ratio relative to the compression ratio.

Firstly, compared to conventional engines, the present invention increases the actual volumetric expansion ratio relative to the actual compression ratio, and leads to greater utilization of the chemical energy contained in the fuel.

Secondly, compared to prior approaches to increasing expansion ratio relative to the compression ratio, the present invention provides simplification of necessary valving (to the point of eliminating the need for additional valving), minimization of passage volume and the associated back-pressure problems, and minimization of wasted expansion volume contained in passageways.

Thirdly, the present invention utilizes dual cylinder expansion to achieve a greater expansion ratio than compression ratio without increasing the number of combustion cylinder valves.

Fourthly, the present invention allows one expander cylinder/piston to serve multiple (i.e., two or four) primary engine cylinders/pistons.

Fifthly, in a preferred embodiment the present invention provides an expander design which operates without intake or exhaust valves, wherein exhaust gas is expelled through lower cylinder exhaust ports.

Sixthly, in yet another preferred embodiment the present invention provides an expander design which utilizes a unique double-piston crank loop mechanism.

DESCRIPTION OF THE PREFERRED EMBODIMENTS

Figure 1:
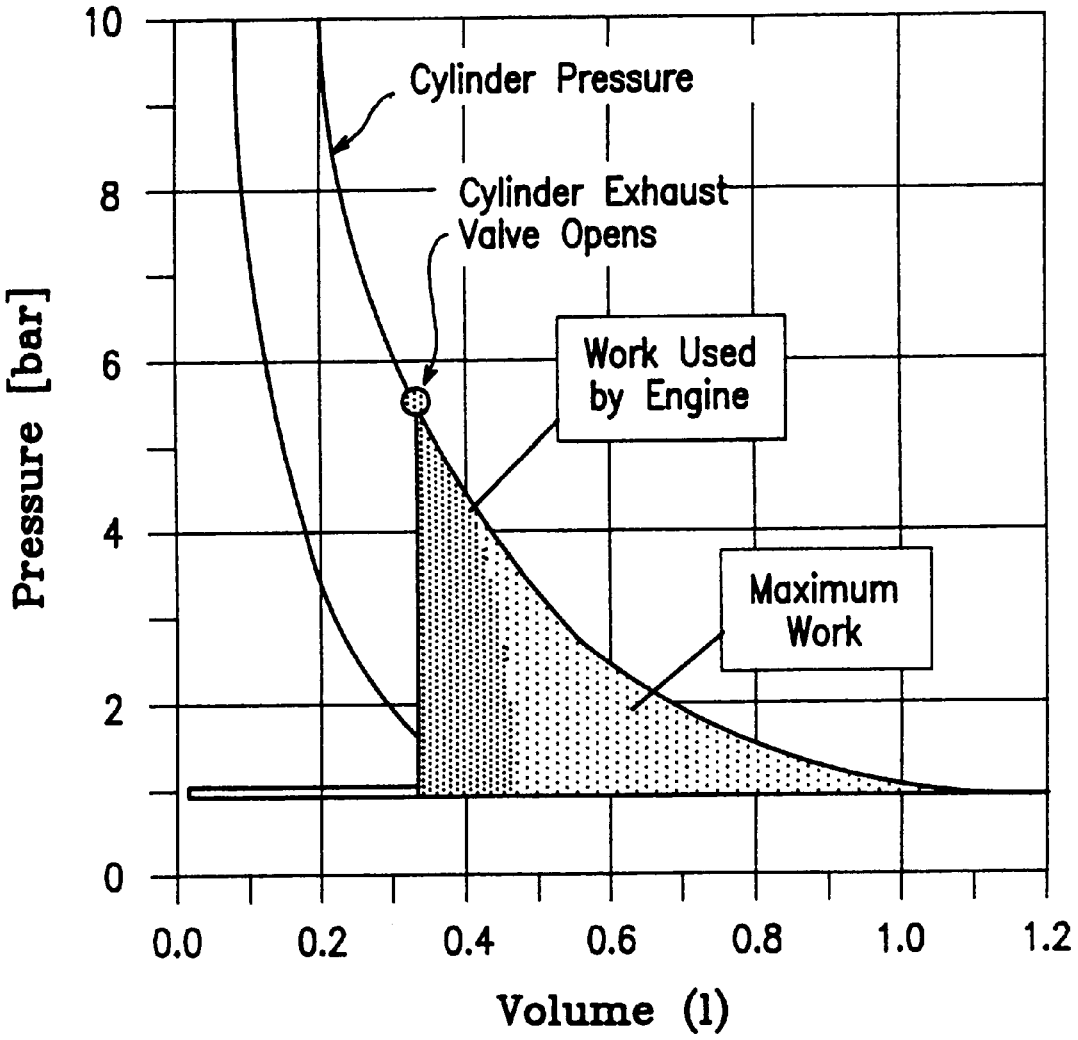
FIG. 1 is a graph of pressure versus volume in a combustion cylinder, illustrating extraction of work from the pressure generated by combustion.
Figure 2:
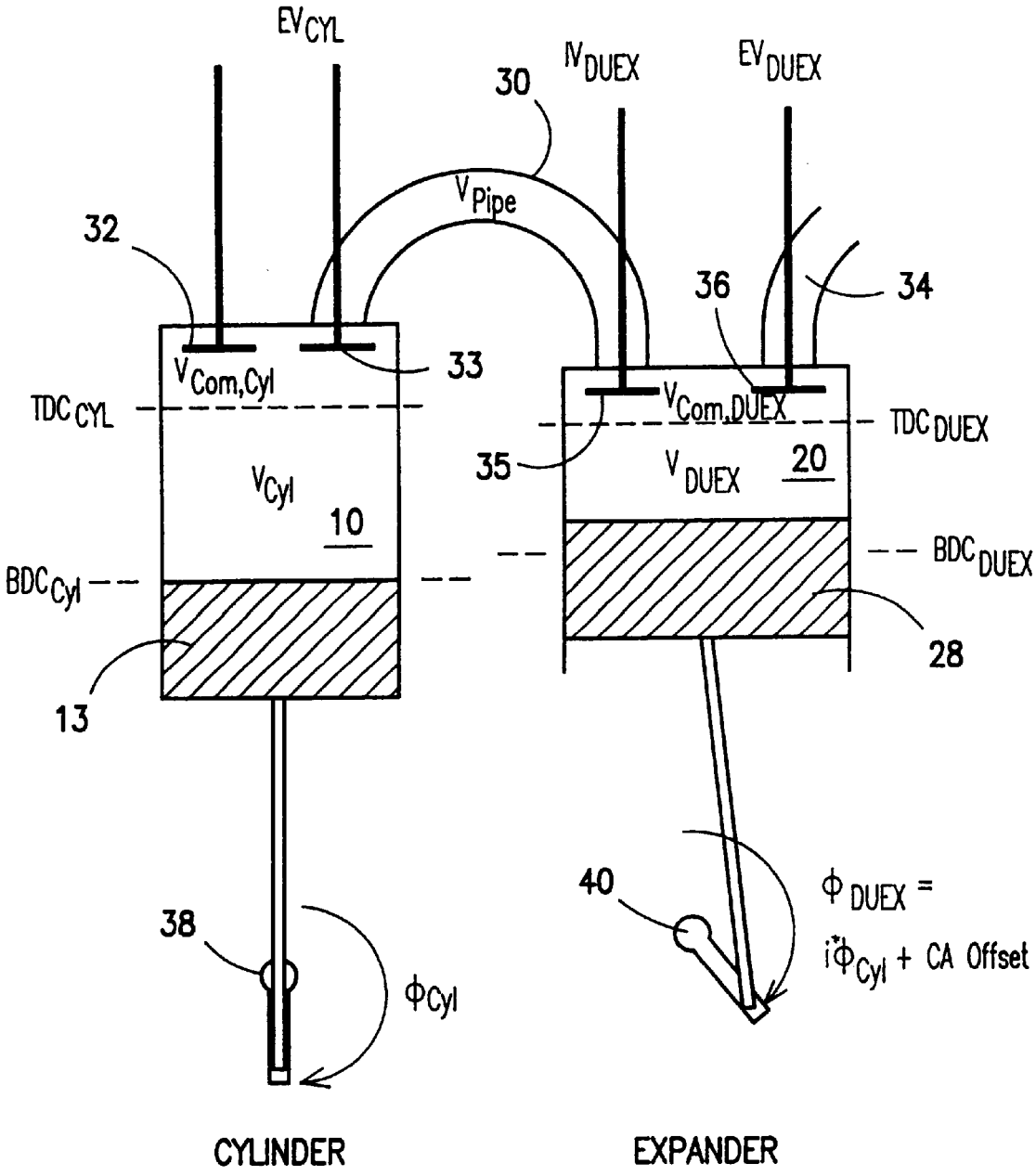
FIG. 2 is a schematic view of a first embodiment of the present invention.

FIG. 2 shows an embodiment of the invention as consisting of at least two cylinders (or rotors for a rotary engine), one of which is a cylinder 10 of an internal-combustion engine and the other a dedicated expansion cylinder 20. Cylinder 10 is provided with a spark plug 49 but the expansion cylinder 20 is devoid of any spark plug, glow plug or other ignition device. The cylinders are united by a short passage or port 30, governed by one-way valve 33 which allows gases to flow from the combustion cylinder 10 to the expansion cylinder 20. There is also a conventional intake passage and valve 32 on the combustion cylinder 10, and a final exhaust passage 34 on the expansion cylinder 20. Both cylinders have a piston 13, 28 against which expanding gases may perform useful work and deliver the work to a rotating crankshaft 38, 40. The expander piston 28 powers a crankshaft 40 separate from the engine crankshaft 38. Both crankshafts 38, 40 are connected although they may be timed differently or have different rotational speeds (depending on the number of power cylinders served by a single expander piston).

Together the two cylinder assemblies 10, 20 perform a role similar to a single conventional engine cylinder. Combustion, ignition, and expansion take place in the engine cylinder 10 in the usual manner. The expansion cylinder 20 provides the means for a second stage of expansion to take place instead of exhausting the gases from the engine cylinder directly to the atmosphere. Thus, the expansion ratio is effectively increased relative to the compression ratio by adding a second expansion volume that is separate from the engine cylinder 10. Since the compression process still takes place entirely within the engine cylinder 10, it remains unchanged.

The expansion cylinder 20 has a piston 28 on which expanding gases from the engine cylinder, having already performed work on the engine piston 13, can continue to perform useful work. Considering both cylinders and the expansion/work therein, the pressure of the exhaust finally exiting from the expander exhaust port 34 is lower than if exhausted from the engine cylinder alone without the further expansion, indicating that additional work was extracted in expansion cylinder 20. The expansion cylinder 20 allows the relatively high-pressure gases that would normally be discarded at the end of the power stroke of the engine cylinder 10 to be used for another power stroke in the expansion cylinder before finally exhausted to the atmosphere.

Figure 3:
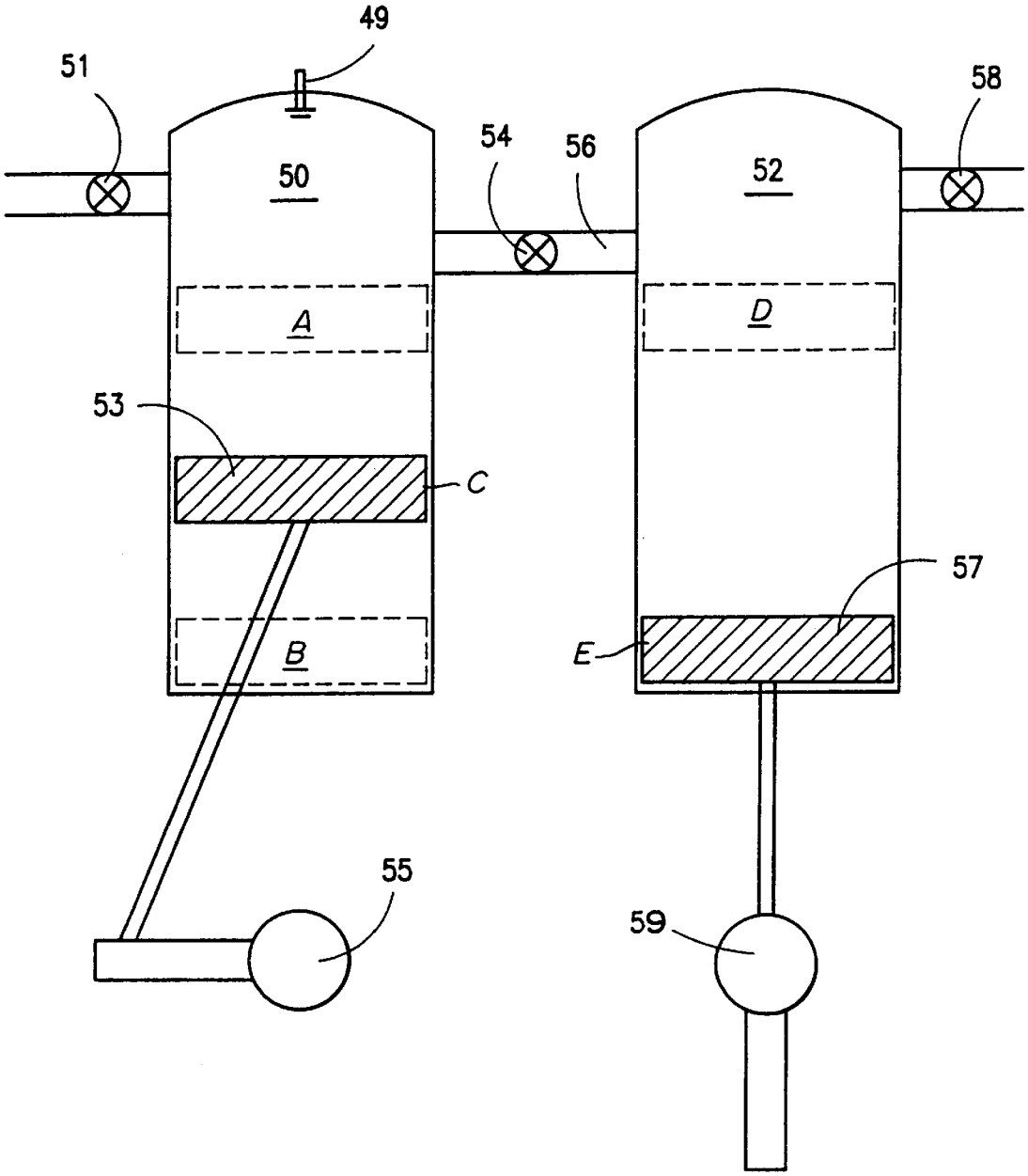
FIG. 3 is a schematic view of a second embodiment of the present invention.

In another preferred embodiment as shown in FIG. 3 a full cycle takes place as follows. During the intake cycle, initiated at or near point (A) (top dead center or "TDC"), the intake valve 51 opens while a one-way valve 54 remains closed. The engine piston 53 travels downward, causing air or air/fuel mixture to be taken into the combustion cylinder 50 as in a typical Diesel or Otto cycle engine. At point (B) (bottom dead center or compression begins as the piston 53 travels upward and intake valve 51 closes (the actual point at which compression begins may vary depending on valve timing). Upon returning to position (A), compression of the air/fuel mixture is complete and combustion begins. The expanding combustion products perform work on the piston 53 as it travels downward, delivering mechanical energy to crankshaft 55. Upon reaching position (B), the expansion within cylinder 50 has reached its maximum and work can no longer be performed on piston 53. At this point, valve 54 opens, allowing the spent gases to be exhausted through connecting passage 56 to expander 52. As gases begin to enter expander 52, piston 53 begins to leave position (B), and the expander piston 57 is positioned at point (D) near the top of its stroke (actual location may vary with relative crank angle timing). While engine piston 53 travels from point (B) to point (C), expander piston 57 travels from point (D) to point (E) at the bottom of its stroke, during which time the spent gases from combustion cylinder 50 perform additional work on expander piston 57. In this embodiment, the speed of the expander crankshaft 59 is twice that of the engine crankshaft 55, allowing one full cycle of the expander 52 to take place for each exhaust cycle of the combustion cylinder 50. This work powers expander crankshaft 59. While the engine piston 53 completes the final portion of its exhaust stroke by traveling from point (C) to point (A), the exhaust of expander 52 takes place through valve 58 as expander piston 57 approaches position "D".

Figure 4:
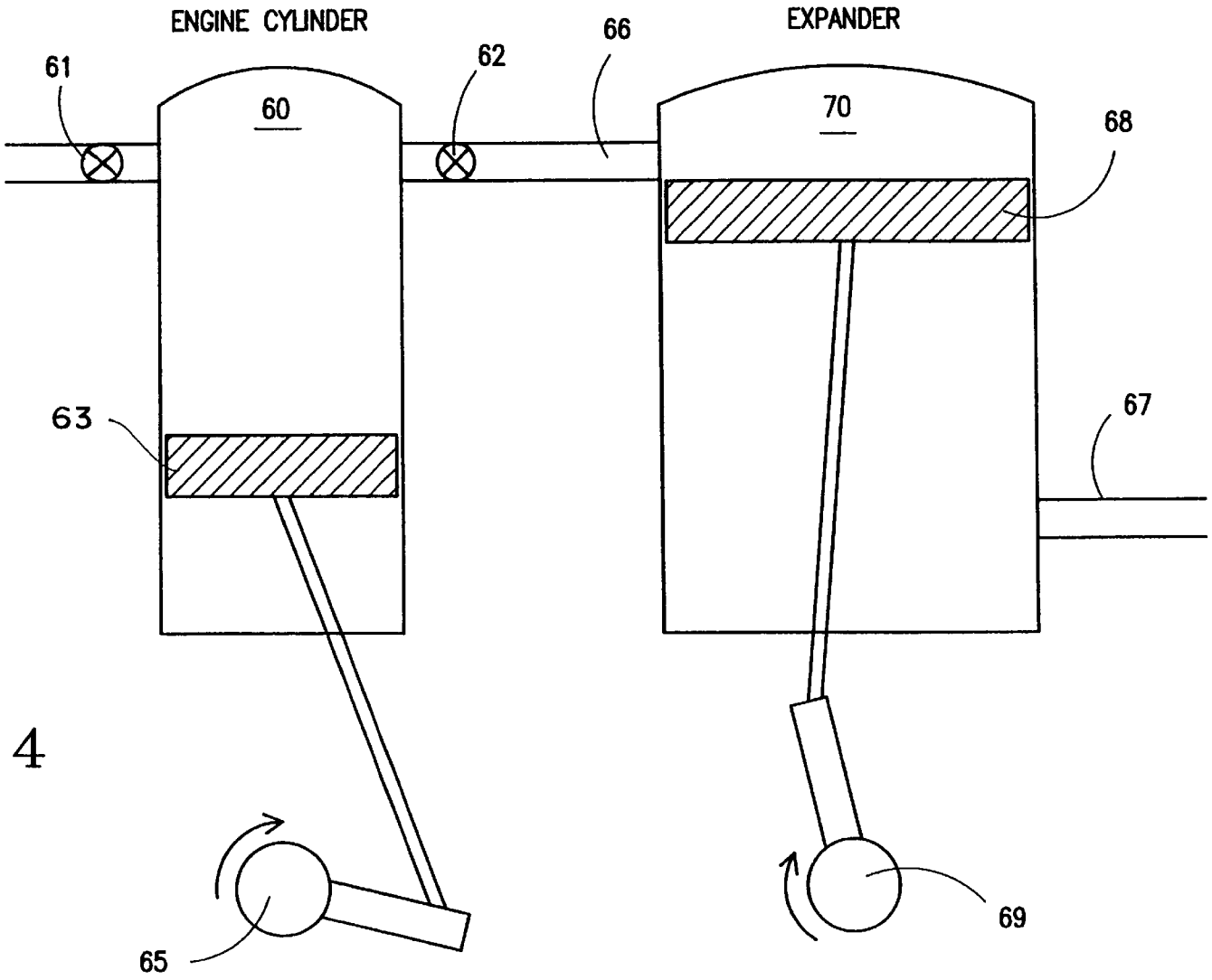
FIG. 4 is a schematic view of a third embodiment of the present invention.
Figure 5:
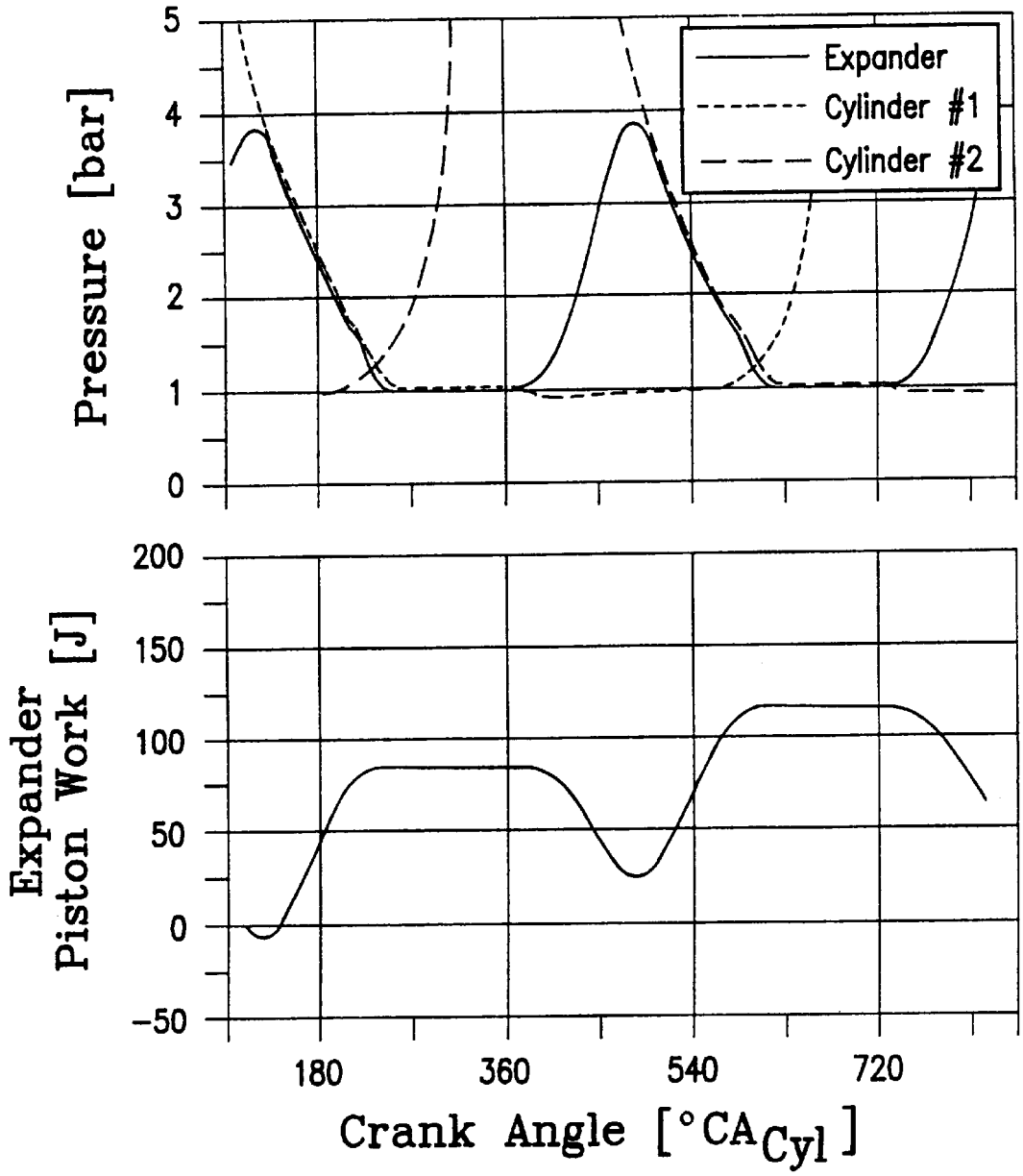
FIG. 5 is a graph of pressures within two combustion cylinders and within a single expander cylinder, receiving exhaust gas from both of the combustion cylinders, versus crank angles and of expander work versus the same crank angles.
Figure 6:
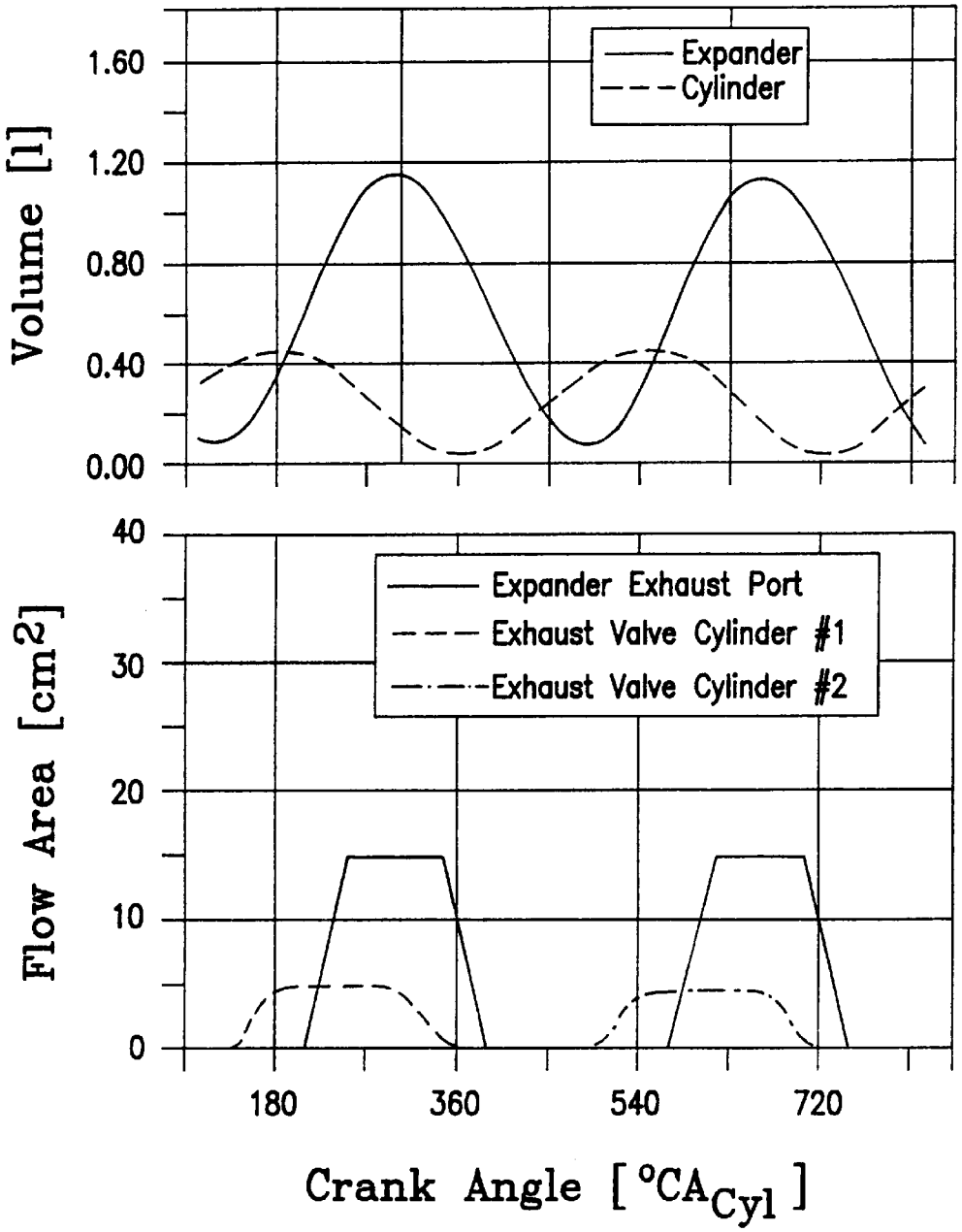
FIG. 6 is a graph of volume within a single combustion chamber and a connected expander cylinder versus crank angles and flow areas of exhaust ports versus the same crank angles.

One salient feature of the embodiment of FIG. 4 is that the expander has no valves. In the embodiment of FIG. 4, for example, the expander inlet gas flow through passage 66 is controlled by the opening and closing of the engine exhaust valve 62. The exhaust of gas from the expander 70 is controlled by the expander piston 57 uncovering openings (exhaust ports 59) in the expander cylinder as it approaches its bottom dead center (BDC) (position "E" in FIG. 3). The timings of the engine crankshaft 65 and the expander crankshaft 69 must be significantly offset to provide proper functioning. For example, in a configuration where the speeds of the engine 60 and expander 70 are equal, the engine has two cylinders operating on a four-stroke cycle, the expander 70 has one cylinder and the swept volume of the expander piston 68 is two and one half times the swept volume of an engine piston 53. As an engine piston 63 is completing its expansion stroke, the expander piston 57 is completing its upward stroke compressing the residual exhaust gas from the previous cycle. At that point where the pressure within the engine cylinder 60 and the pressure within the expander 70 are equal, the engine exhaust valve 62 begins opening. As the engine piston 63 crosses BDC on its expansion stroke and begins the upward motion of its "exhaust" stroke, the expander piston 57 crosses top dead center (TDC) and begins its downward or expansion stroke. Since the swept volume of the expander piston 57 is greater than that of an engine piston 53, the combustion gases experience a greater expansion than what would have been experienced in the engine alone. As the engine piston 53 approaches TDC, its exhaust valve 54 begins shutting, and the expander piston 57 approaches BDC (position "E"). The expander exhaust ports 58 must be open for a sufficient period (i.e., number of crank angle degrees) for exhaust gases to be expelled equivalent to the last engine cycle exhaust gas mass. As the expander piston 57 crosses BDC and begins its upward "compression" stroke, the piston from the other engine cylinder is beginning its expansion stroke, and the expander cycle repeats. FIGS. 5 and 6 show engine cylinder and expander volumes, valve and port flow areas (i.e., valve opening and closing timings), engine cylinder and expander pressures, and expander piston work as a function of crank angle, for the case where the crank angle offset is 120° and the expander exhaust port "event" is 184° crank angle.

In many embodiments, the speed of the expander crankshaft 59 will be greater than that of the engine crankshaft 55, and the crank angles will differ, but these relationships need not hold for all embodiments. In the embodiment of FIG. 4, the expander 70 operates at twice the speed of the engine, so that one complete expansion and exhaust cycle in the expander 70 takes place for each exhaust stroke of an engine cylinder 60. In this manner, up to four engine cylinders can be served by a single expander.

As shown in FIG. 6, the expansion ratio for a combustion cylinder operated in accordance with the present invention is typically about 1:18, ranging from about 1:10 to above 1:25, and the expansion ratio for the expansion cylinder is typically about 1:10, ranging from about 1:8 to about 1:12. As seen in FIG. 5 the exhaust from the combustion cylinder is typically received by the expansion cylinder at 3.5–4.0 bars and exhausted at 1 bar (ambient). The relationship between crank angles is also shown in FIGS. 5 and 6. In order to minimize NOx formation ignition is started within the interval of from 10° before top dead center in the compression stroke to 5° after top dead center in the expansion stroke.

Figure 7:
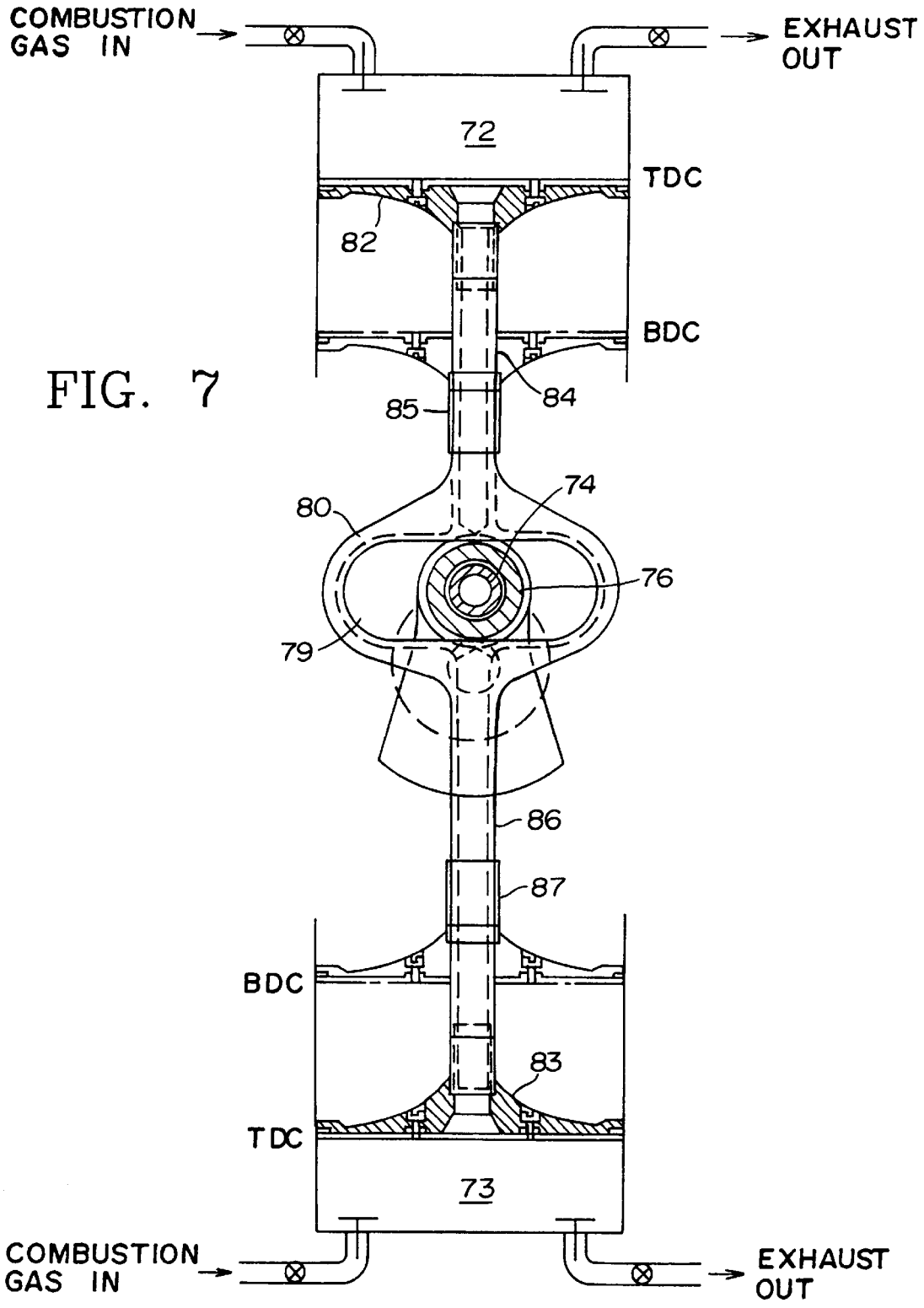
FIG. 7 is a schematic view of paired expansion cylinders in a third embodiment of the invention.

In order to produce net positive work in an expander, from the further expansion of an engine's residual exhaust gas pressure, the expander's frictional losses must be less than the potential work extractable by the expander. FIG. 7 shows a unique double piston crank loop expander design. While single-piston crank loop designs are well known, as are their low friction characteristics, utilizing pistons on each end of a single crank loop mechanism provides a doubling of the expander capacity with only a modest increase in cost as compared to utilizing two separate single-piston crank loop mechanisms. As shown in FIG. 7, first and second expander cylinders 72, 73 are aligned on opposite sides of an expander crankshaft 74 with cam 76 engaging a continuous camming surface 79 of cam follower 68. Piston 82 of expander cylinder 72 is connected to the cam follower 80 through a piston shaft 84 for reciprocating motion between TDC and BDC, the linearity of which is ensured by bushing 85, surrounding piston shaft 84. Likewise, piston 83 within expander cylinder 73 is connected to cam follower 80 through a second piston shaft 86. The linearity of the reciprocating motion of piston 83 and piston shaft 86 is likewise ensured by bushing 87. In the embodiment shown in FIG. 7 piston shafts 84 and 86 are integral with cam follower 80.

Figure 8:
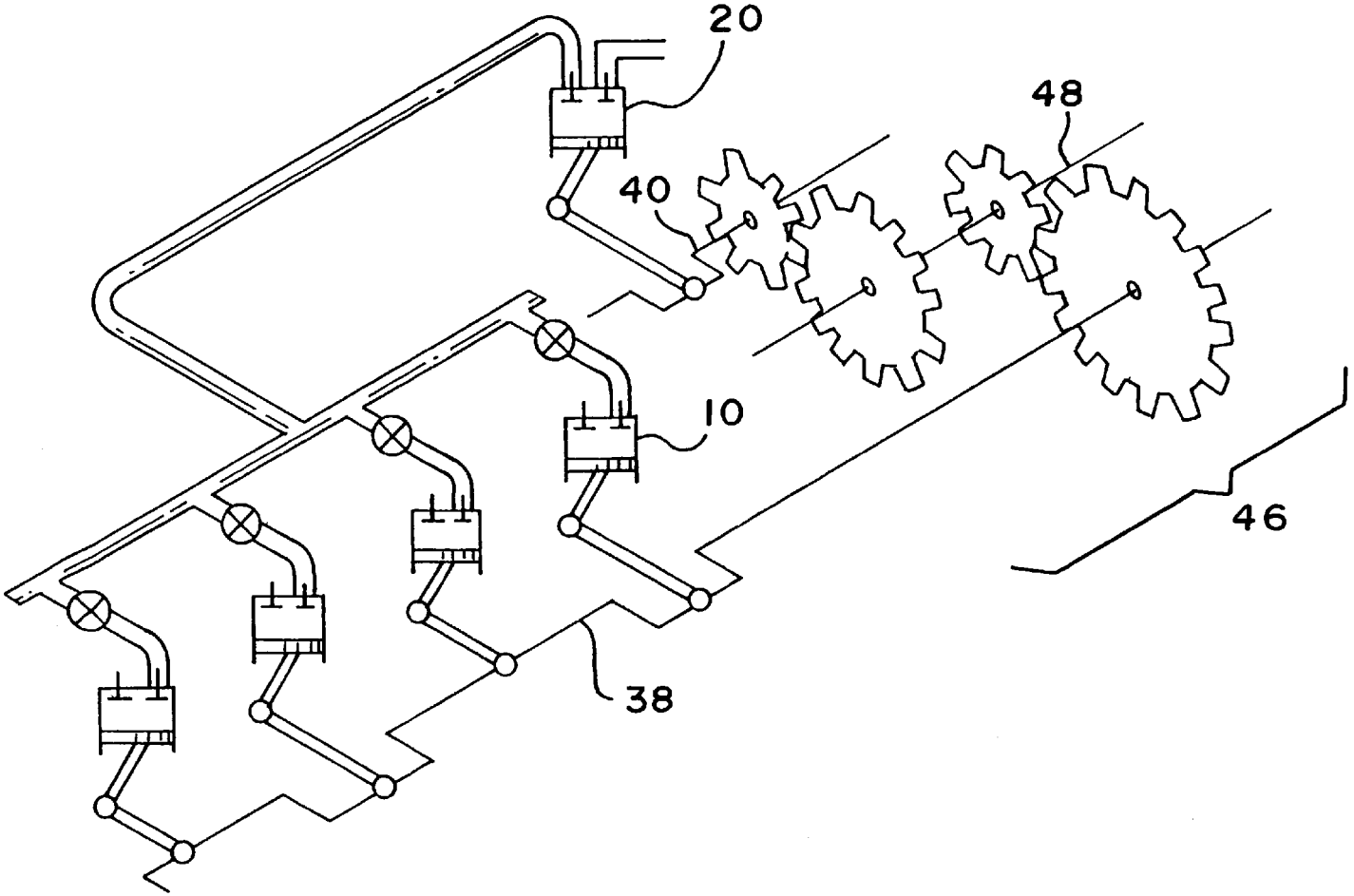
FIG. 8 is a schematic view of gearing connecting the engine crankshaft with the expander crankshaft.

FIG. 8 shows gearing connecting the outputs of engine crankshaft 38 and expander crankshaft 40 at a single drive shaft 48 which connects with a conventional differential and, through that differential, left-hand and right-hand wheel shafts. At 18 is a schematic representation of gearing for combining the outputs of the two crankshafts 40, 46. In the embodiment shown in FIG. 8, the single expansion cylinder 20 completes one cycle (a compression stroke and an expansion stroke) for each exhaust stroke of a combustion cylinder 10 and receives exhaust gas from four combustion cylinders 10.

Preliminary studies suggest that the efficiency of the invention may be optimized by varying many of the parameters mentioned above. For instance, it was found that there are benefits to having the flow area of the expander exhaust be significantly larger than the flow area of the engine exhaust port, to have the expander crankshaft operate at the same speed as the engine crankshaft, to have two engine cylinders for each expander cylinder, and an expander displacement about 2.5 times that of the engine cylinder displacement. None of these specific variations are considered to be a departure from the basic design or operating principles of the invention. Naturally, optimization of the design or specific purposes or for maximum efficiency may call for variation of parameters such as the timing of the relative crank angles of engine and expander, relative crankshaft speeds, valve timing, valve types, presence of valves between the combustion cylinder(s) and expander(s), relative flow areas of engine exhaust and expander exhaust, relative displacement of engine cylinder(s) and expander cylinder(s), expander volumetric expansion ratio, and the number of combustion cylinders served by each expander. Such variations are considered to be consistent with the spirit of the invention and within the scope of the claims.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. An internal combustion engine comprising:

at least one combustion cylinder having an intake port for intake of combustion air, an exhaust port for exhausting of gaseous products of combustion within said combustion cylinder and ignition means for igniting an air-fuel mixture therein to produce combustion;

a combustion piston mounted within said combustion cylinder for reciprocating motion therein responsive to combustion within said combustion cylinder;

an engine crankshaft connected to and rotatably driven by the reciprocating motion or said combustion piston;

at least one expansion cylinder having a gas inlet port for intake of the gaseous products of combustion exiting said combustion cylinder and a gas outlet port for exhausting all the gaseous products exiting after expansion within said expansion cylinder;

an expander piston mounted within said expansion cylinder reciprocating motion therein, responsive to the expansion of gaseous products of combustion between a top dead center and a bottom dead center, said gas outlet port being located between the top dead center and the bottom dead center, closer to bottom dead center, whereby said expander piston serves as a valve for said gas outlet port, permitting the exhaust of the gaseous products from the expansion cylinder as the expander piston uncovers said gas outlet port in approaching bottom dead center;

an expander crankshaft connected to and rotatably driven by the reciprocating motion of said expander piston;

a gas passage connecting said exhaust port of said combustion cylinder with said gas inlet port of said expansion cylinder;

a single valve located between said exhaust port and said gas inlet port regulating both the exhaust gas of the gaseous products from said combustion cylinder and the intake of the gaseous products into said expansion cylinder; and a drive shaft rotatably driven by said engine crankshaft and by said expander crankshaft.

2. An internal combustion engine according to claim 1 comprising four of said combustion cylinders and four of said combustion pistons connected to said engine crankshaft, said gas passage connecting the exhaust ports of said four combustion cylinders to said gas inlet port and, further comprising valve means for feeding products of combustion from said four combustion cylinders, in succession, to said expansion cylinder.

3. An internal combustion engine according to claim 1 wherein the expander cylinder has a displacement about 2.5 times that of the combustion cylinder.

4. An internal combustion engine according to claim 1 further comprising:

a second expansion cylinder having a gas inlet port for intake of gaseous products of combustion and a gas outlet port for exhausting the gaseous products after expansion within said second expansion cylinder;

a first piston shaft connecting the expander piston of said one expansion cylinder to a single cam follower and a second piston shaft connecting the expander piston of said second expansion cylinder to said cam follower opposite and in alignment with said first piston shaft, said cam follower having a single opening defining a continuous camming surface, said cam follower being mounted on said expander crank shaft with said continuous camming surface in contact with a cam on said expander crank shaft.

5. A method of powering a wheeled vehicle comprising:

igniting a mixture of fuel and air within a combustion cylinder and allowing gaseous products of combustion to expand within said combustion cylinder to drive a combustion piston therein with reciprocating movement within the combustion cylinder between top dead center and bottom dead center, the piston being connected to an engine crankshaft for outputting a first torque through the engine crankshaft in an expansion stroke and for receiving power from said crankshaft in a compression stroke;

timing said igniting to occur at an engine crankshaft angle of from 10° before top dead center in the compression stroke to 5° after top dead center in the expansion stroke;

exhausting the gaseous products of combustion from the combustion cylinder at a pressure substantially above atmospheric and introducing the gaseous products of combustion into an expansion cylinder having a cylindrical side wall and expanding the gaseous products of combustion within the expansion cylinder, without further combustion, to drive an expander piston from top dead center to bottom dead center;

extracting a second torque from the driving of the expander piston through an expander crankshaft;

exhausting all of the gaseous products of combustion exiting from the expansion cylinder to the ambient atmosphere only through an exhaust port located in said cylindrical side wall; and controlling the flow of exhaust through the exhaust port with said expander piston serving as a valve for the exhaust port, permitting the exhaust of the gaseous products of combustion from the expansion cylinder, as the expander piston uncovers the gas outlet port in approaching bottom dead center;

combining said first and second torques to drive wheels of the vehicle.

6. A method according to claim 5 wherein a fuel-air admixture is ignited in an even number of combustion cylinders and wherein the gaseous products of combustion are fed to the expansion cylinder, in succession, from the even number of combustion cylinders.

7. A method according to claim 6 wherein the expander crankshaft is driven at a rotary speed twice the rotary speed at which the engine crankshaft is driven.

8. A method according to claim 5 wherein the gaseous products of combustion are exhausted from the combustion cylinder and introduced into the expansion cylinder at 3.5–4.0 bars.

* * * * *